US005823533A

United States Patent [19]

Edwards

[11] Patent Number: 5,823,533

[45] Date of Patent: Oct. 20, 1998

[54] PUZZLES IN TWO AND THREE DIMENSIONS

[76] Inventor: Boyd F. Edwards, 19 W. Jefferson St., Westover, W. Va. 26505

[21] Appl. No.: 823,048

[22] Filed: Mar. 21, 1997

[51] Int. Cl.[6] ..... A63F 9/12

[52] U.S. Cl. ..... 273/160

[58] Field of Search ..... 273/157 R, 160, 273/156, 153 R

[56] References Cited

U.S. PATENT DOCUMENTS

| | | | |
|---|---|---|---|
| 3,065,970 | 11/1962 | Besley | 273/160 |
| 4,210,333 | 7/1980 | Shanin | 273/157 R |
| 4,844,466 | 7/1989 | Johnson et al. | 273/157 R |
| 5,393,063 | 2/1995 | Ichimaru | 273/160 |

FOREIGN PATENT DOCUMENTS

| | | | |
|---|---|---|---|
| 2290626 | 6/1976 | France | 273/160 |
| 1154 | of 1906 | United Kingdom | 273/160 |

*Primary Examiner*—Steven B. Wong
*Attorney, Agent, or Firm*—L. E. Carnahan

[57] ABSTRACT

A puzzle consisting of eight component pieces which fit together to fill out the volume of a cube four units wide by four units long by four units high, and also fill out the volume of a square eight units wide by eight units long by one unit high. A unit may be any length measurement unit, such as a centimeter. The volumes of the cube and the square are subdivided into sixty-four unit cubes, each unit cube having dimensions one unit by one unit by one unit. Each of the eight component pieces consists of eight unit cubes joined firmly together with their side surfaces flush one against the other, to form a connected two-dimensional shape of unit thickness. In six of the ten embodiments disclosed herein, all of the surfaces of pieces that comprise the top surface of the square assemblage become interior surfaces in the cube assemblage, thereby allowing for separate pictures to appear on the top surface of the square assemblage and the outside surfaces of the cube assemblage.

20 Claims, 7 Drawing Sheets

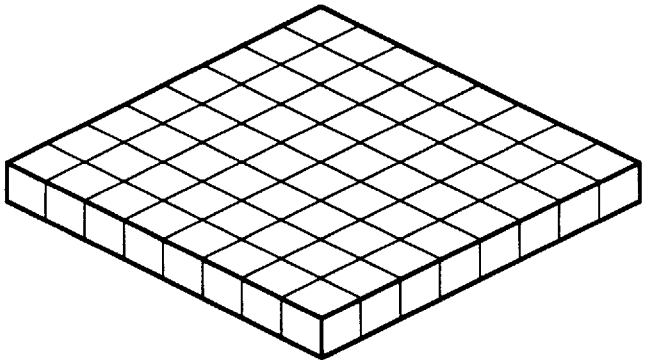
Fig. 1
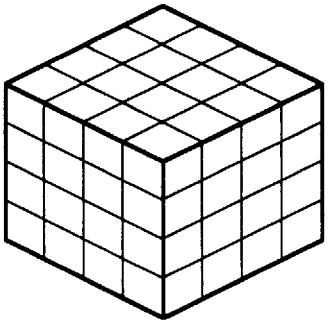
Fig. 2
| | | | |
|---|---|---|---|
| 13 | 14 | 15 | 16 |
| 9 | 10 | 11 | 12 |
| 5 | 6 | 7 | 8 |
| 1 | 2 | 3 | 4 |
Fig. 3

PUZZLES IN TWO AND THREE DIMENSIONS

BACKGROUND OF THE INVENTION

The present invention relates to puzzles, particularly to two/three dimensional puzzles, and more particularly to two/three dimensional puzzles utilizing the same puzzle pieces.

Puzzles are among the most widespread and persistent forms of human recreation because of their direct challenge to the intellect, the satisfaction accompanying their solution, and the interesting manner in which seemingly unrelated pieces finally fit together to form a pleasing whole. Central to our interest in puzzles is our basic fascination with shapes and symmetries and with their relationships with each other.

Puzzles in the prior art can normally be classified as either two-dimensional (Johnson U.S. Pat. No. 4,844,466; Cook U.S. Pat. No. Des. 238,698) or three-dimensional (Johnson U.S. Pat. No. 4,784,392; Vachek U.S. Pat. No. 4,662 638). Two-dimensional puzzles, as used herein, involve flat pieces of uniform thickness which fit together side-by-side to completely cover the interior of a well-defined two-dimensional shape such as a square or a rectangle. An example of a two-dimensional puzzle is the traditional jigsaw puzzle. Three-dimensional puzzles, as used herein, involve pieces which fit together in more complicated ways, both in the vertical dimension and in two horizontal dimensions, to completely fill the interior volume of a well-defined three-dimensional shape such as a cube. Many three-dimensional assemblages in the prior art, including the interrelated Johnson patents, contain at least one piece which is three-dimensional, making it impossible to construct a two-dimensional assemblage from the same set of pieces. Other known puzzles involve six flat pieces which can be assembled to form a hollow cube, with each piece forming one of the six faces of said cube. Two-dimensional assemblages of such pieces can also be found, although these assemblages have ragged boundaries and do not completely cover the interior of a well-defined two-dimensional shape such as a square or a rectangle. Thus, such puzzles do not qualify either as strictly two-dimensional (because of the ragged edges) or as strictly three-dimensional (because of the hollowness of the cube) under the present definitions.

The present invention comprises puzzle pieces that can be assembled in both two and three dimensions, thus differing from the prior art efforts. Ten separate sets of puzzle pieces that utilize the two/three dimension arrangements of this invention are disclosed as separate embodiments herein. Each of these embodiments involves a set of pieces which (a) can be assembled in two dimensions to completely cover the interior of a square and (b) can also be assembled in three dimensions to completely fill the interior volume of a cube. Six of these embodiments have a "hidden surface" feature in which all of the surfaces of pieces that comprise the top surface of the square assemblage become interior surfaces in the cube assemblage. This feature allows a color, pattern, or picture drawn on the top surface of the square assemblage to be completely hidden within the cube assemblage, thereby allowing distinct colors, patterns, or pictures to also appear on all six outside faces of the cube assemblage. Such colors, patterns, or pictures can greatly reduce the puzzle complexity, if desired, by providing additional assembly clues, and can serve to make the puzzles more pleasing visually.

SUMMARY OF THE INVENTION

An object of the present invention is to provide a set of puzzle pieces which can be assembled in both two and three dimensions.

Another object of the present invention is to provide a set of puzzle pieces which (a) can be assembled in two dimensions to completely cover the interior of a square and (b) can be assembled in three dimensions to completely fill the interior volume of a cube.

Another object of the present invention is to provide a set of eight pieces which can be assembled to form (a) a completed square two-dimensional puzzle, eight units wide by eight units long by one unit thick, and (b) a three-dimensional puzzle comprising a completed cube whose dimensions are four by four by four units.

Another object of the present invention is to provide a two/three dimensional puzzle wherein each puzzle piece is one unit thick and has a top surface area of eight square units.

Another object of the invention is to provide a two/three dimensional puzzle utilizing eight pieces wherein each one of the eight pieces is distinct from the other seven pieces.

Another object of the present invention is to provide a two/three dimensional puzzle such that no more than two pieces comprise a mated pair.

Another object of the invention is to provide a two/three dimensional puzzle wherein each of eight unit cubes comprising a single piece is unique and distinct from the other seven unit cubes.

Other objects and advantages of the present invention will become apparent from the following description and accompanying drawings. The objective of the invention is to identify a set of puzzle pieces that can be assembled in two and three dimensions. It is possible to accomplish this by specifying a square two-dimensional assemblage of dimensions 8×8×1 units and a cubic three-dimensional assemblage of dimensions 4×4×4 units, and by constructing puzzle pieces to completely fill the volumes of these assemblages using sixty-four unit cubes, each of dimensions 1×1×1 unit. These highly symmetric square and cubic assemblages are more aesthetic than the oft-used but less-symmetric rectangular or rectangular parallelopiped assemblages. Clearly, pieces must have unit thickness to fit into the square assemblage, and must have maximum horizontal dimensions 4×4 units to fit into the cube assemblage. Accordingly, to allow for a large variety of piece shapes while maintaining consistency in their sizes, each piece is constructed of eight unit cubes joined firmly together with their side surfaces flush one against the other, to form a connected two-dimensional shape of maximum dimensions 4×4×1 units. Eight such pieces are necessary to complete the square and cube assemblages. To maximize the intellectual challenge, the pieces are required to be distinct and are required to include not more than one mated pair, a mated pair consisting of two pieces that can be placed together to completely fill out a volume of dimensions 4×4×1 units.

If four mated pairs of pieces were allowed (rather than allowing a maximum of one), then the square and cube assemblages would be very simple and would be closely related: the cube assemblage would be accomplished by stacking the mated pairs one above another to form a 4×4×4 cube, whereas the square assemblage would be accomplished by placing the mated pairs side by side, with corners of the four mated pairs meeting at a central point, to form an 8×8×1 square; the mated pairs would maintain their mated relationship in both the square and cube assemblages, and all pieces would maintain a horizontal orientation in both the square and cube assemblages. Allowing at most one mated pair precludes such simple assemblages, requires that some pieces assume a vertical orientation in the cube assemblage, and thereby renders the puzzles more challenging intellectually. Puzzles comprising four mated pairs of pieces are simple to invent, whereas puzzles allowing a maximum of one such pair are much more difficult.

The linear dimension L=4 of the 4×4×4 cube assemblage is unique, being the smallest nontrivial linear dimension for which a set of pieces that fill out the cube assemblage can also completely fill out a square assemblage of unit thickness without overfilling. The sixty-four unit cubes needed to fill out the 4×4×4 cube assemblage also completely fill out an 8×8×1 square assemblage. In contrast, the linear dimension L=3 for a 3×3×3 cube assemblage has no corresponding square assemblage because it is impossible to arrange the associated 27 unit cubes onto a square of unit thickness; these unit cubes would overfill a 5×5×1 square and would underfill a 6×6×1 square. The only linear dimensions L of L×L×L cube assemblages which allow assembly on a square of unit thickness (without underfilling or overfilling) are squares of positive integers. That is, such linear dimensions must satisfy $L=N^2$, with N=1,2,3,etc. The linear dimensions D of the corresponding D×D×1 square assemblages must satisfy $D=N^3$, with the same value of N, to avoid overfilling or underfilling the square assemblage. If L and D are specified by $L=N^2$ and $D=N^3$ for some value of N, then the volumes of the L×L×L cube assemblage and of the D×D×1 square assemblage will be equal to each other, both volumes being equal to $N^6$. This volume also gives the number of unit cubes required in each assemblage; the number of unit cubes in the square and cube assemblages must be identical lest one of the assemblages be overfilled or underfilled. The value N=2 corresponds to the 4×4×4 cube and 8×8×1 square assemblages discussed above. Clearly, the value N=1 is trivial and uninteresting since it involves only a single unit cube, which itself completely fills out the 1×1×1 cube and 1×1×1 square assemblages. The value N=3 corresponds to a 9×9×9 cube assemblage and a 27×27×1 square assemblage, requiring a total of 729 unit cubes for its construction. Hence, a 4×4×4 cube assemblage and the corresponding 8×8×1 square assemblage stand out as a unique and highly symmetric choice for puzzles in two and three dimensions, and even allow for separate pictures to appear on the top surface of the square and the outside surfaces of the cube.

An object of the invention is to allow for a large variety of piece shapes while keeping the number of pieces reasonably large, while maintaining consistency in the number of unit cubes in the pieces. This can be accomplished for an L×L×L cube assemblage and a D×D×1 square assemblage with $L=N^2$ and $D=N^3$, where N is a positive integer greater than one, by specifying D as the number of unit cubes per piece. For this choice, the number of pieces must also be D to give the correct total number $N^6$ of unit cubes in each assemblage. For N=2, this procedure requires eight puzzle pieces, with eight unit cubes per piece, for the 4×4×4 cube and 8×8×1 square assemblages. For N=3, this procedure requires 27 puzzle pieces, with 27 unit cubes per piece, for the 9×9×9 cube and 27×27×1 square assemblages. The latter puzzle might indeed be formidable to solve.

Ten separate sets of pieces that satisfy the above criteria are disclosed herein as separate embodiments. Six of these embodiments have a "hidden surface" feature in which all of the surfaces of pieces that comprise the top surface of the 8×8×1 square assemblage become interior surfaces of the 4×4×4 cube assemblage.

BRIEF DESCRIPTION OF THE DRAWINGS

FIG. 1 is a perspective view of the overall two-dimensional shape of the square assemblage of dimensions 8×8×1 units.

FIG. 2 is a perspective view of the overall three-dimensional shape of the cube assemblage of dimensions 4×4×4 units.

FIG. 3 is a top view of the numbered unit cubes used to define the puzzle piece shapes.

DETAILED DESCRIPTION OF THE INVENTION

The present invention is directed to a two/three dimensional puzzle, wherein the same puzzle pieces can be utilized in either a two-dimensional or a three-dimensional puzzle. Ten separate sets of puzzle pieces that satisfy the criteria set forth above are illustrated. Each of the ten sets or embodiments of the present invention consists of a set of eight puzzle pieces that can be assembled to form both a two-dimensional square of dimensions 8×8×1 units and a three-dimensional cube of dimensions 4×4×4 units. FIGS. 1 and 2 show the overall shapes of the square and cube assemblages, respectively, including the divisions of these assemblages into sixty-four unit cubes, each of dimensions one by one by one unit.

Figure 4:
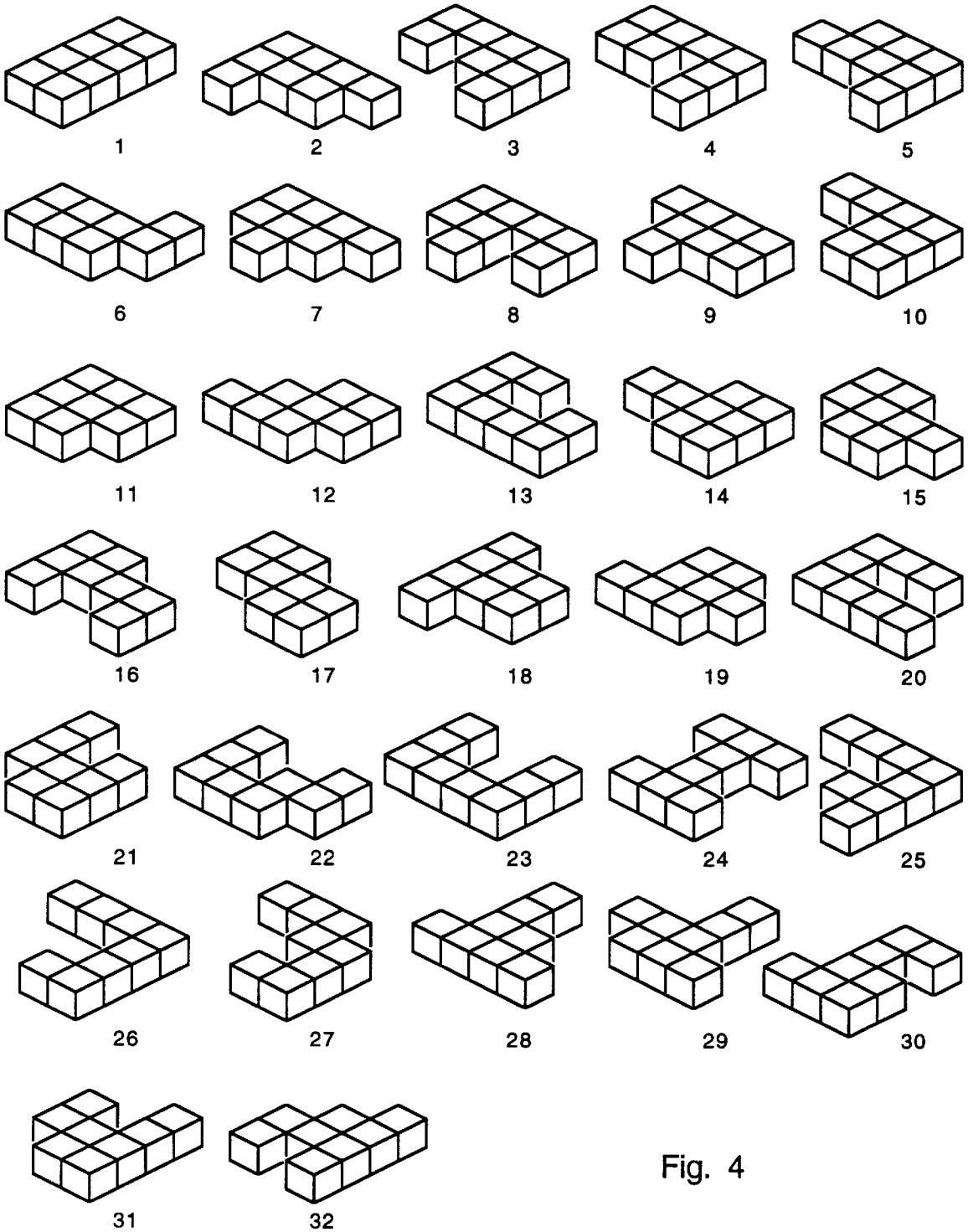
FIG. 4 is a perspective view of the 32 puzzle pieces needed to form the ten embodiments of the invention.

The puzzle pieces comprising the ten embodiments are drawn from a pool of 32 puzzle pieces. Each piece consists of eight unit cubes joined firmly together with their side surfaces flush one against the other, to form a connected two-dimensional shape of unit thickness. Each puzzle piece has a top surface area of eight square units, and fits within a bounding area of dimensions four by four units. FIG. 3 shows such a bounding area, within which sixteen individual unit squares are labelled by the integers 1 through 16. FIG. 3 is used herein as a device to define the shapes of the 32 puzzle pieces, whose perspective views are shown in FIG. 4. Each of the puzzle pieces shown in FIG. 4 is defined by the eight unit squares that it occupies in FIG. 3. For example, puzzle piece 1 in FIG. 4, a rectangular shape of dimensions two by four by one unit, is constructed by placing unit cubes on each of the eight unit squares numbered 1, 2, 3, 4, 5, 6, 7, and 8 in FIG. 3, and then by joining these cubes together to form a single connected piece. Similarly, puzzle piece 2 in FIG. 4, a right-triangular shape with perpendicular sides of length three and four units, is constructed by placing unit cubes on each of the eight unit squares numbered 4, 7, 8, 11, 12, 14, 15, and 16 in FIG. 3. In each case, the unit cubes comprising a particular piece are considered to be firmly connected together with side faces flush one against the other, forming a connected two-dimensional object one unit thick, with a top surface area of eight square units. Table I gives the unit square numbers comprising each of the 32 puzzle pieces, thereby defining the 32 pieces shown in FIG. 4.

TABLE I

| Piece No. | Component Unit Cubes | Piece No. | Component Unit Cubes |
|---|---|---|---|
| 1 | 1, 2, 3, 4, 5, 6, 7, 8 | 17 | 1, 2, 5, 6, 10, 11, 14, 15 |
| 2 | 4, 7, 8, 11, 12, 14, 15, 16 | 18 | 2, 3, 6, 7, 9, 10, 11, 12 |
| 3 | 2, 3, 4, 7, 8, 12, 15, 16 | 19 | 2, 5, 6, 7, 9, 10, 11, 13 |
| 4 | 2, 3, 4, 8, 11, 12, 15, 16 | 20 | 1, 5, 7, 9, 11, 13, 14, 15 |
| 5 | 2, 3, 4, 7, 8, 11, 12, 15 | 21 | 1, 2, 3, 5, 6, 10, 11, 12 |
| 6 | 3, 4, 6, 7, 10, 11, 14, 15 | 22 | 2, 3, 5, 6, 9, 13, 14, 15 |
| 7 | 4, 7, 8, 10, 11, 12, 15, 16 | 23 | 1, 2, 3, 5, 9, 13, 14, 15 |
| 8 | 3, 4, 8, 10, 11, 12, 15, 16 | 24 | 1, 4, 5, 6, 7, 8, 9, 12 |
| 9 | 3, 4, 7, 8, 10, 11, 12, 16 | 25 | 1, 2, 3, 4, 6, 8, 12, 16 |
| 10 | 2, 3, 4, 6, 7, 8, 12, 16 | 26 | 1, 2, 3, 4, 5, 8, 12, 16 |
| 11 | 3, 4, 6, 7, 8, 10, 11, 12 | 27 | 1, 2, 3, 5, 7, 8, 12, 16 |
| 12 | 3, 4, 6, 7, 8, 10, 11, 14 | 28 | 1, 5, 6, 9, 10, 11, 12, 13 |
| 13 | 1, 2, 5, 9, 11, 13, 14, 15 | 29 | 1, 5, 6, 7, 8, 9, 10, 14 |
| 14 | 1, 2, 3, 5, 6, 7, 10, 14 | 30 | 1, 2, 4, 5, 6, 7, 8, 9 |
| 15 | 2, 5, 6, 9, 10, 11, 14, 15 | 31 | 1, 2, 3, 4, 5, 6, 10, 11 |
| 16 | 1, 2, 6, 10, 11, 13, 14, 15 | 32 | 1, 2, 3, 4, 6, 7, 9, 10 |

Figure 5:
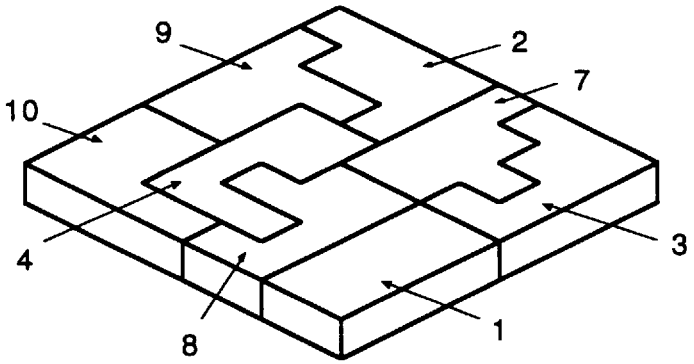
FIG. 5 is a perspective view of a particular set of puzzle pieces assembled to form a two-dimensional square.
Figure 6:
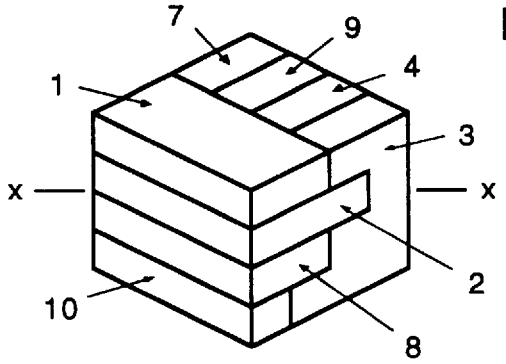
FIG. 6 is a perspective view of the same set of puzzle pieces as in FIG. 5, assembled to form a three-dimensional cube.
Figure 7:
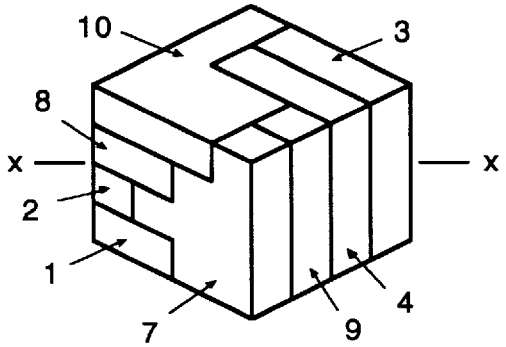
FIG. 7 is a perspective view of the configuration of FIG. 6 shown rotated 180 degrees about the axis x—x.

The first embodiment (FIGS. 5–7) consists of piece numbers 1, 2, 3, 4, 7, 8, 9 and 10 in FIG. 4. FIG. 5 shows one of 16 ways in which these pieces can be assembled to form a square, whereas FIG. 6 shows one of 4 ways in which these same pieces can be assembled to form a cube. FIG. 7 shows the same configuration as FIG. 6, but is rotated by 180 degrees about the axis x—x to show the back side of the cube. The top surfaces of pieces 1–4 and 7–10 in the square assemblage in FIG. 5 may be visualized as being shaded, whereas all other surfaces of these pieces may be considered to be unshaded. None of the top surfaces of these pieces appear on outside surfaces of the cube assemblages of FIG. 6 and 7, hence all of the top surfaces on this square assemblage (FIG. 5) become interior or "hidden" surfaces in this cube assemblage.

Figure 8:
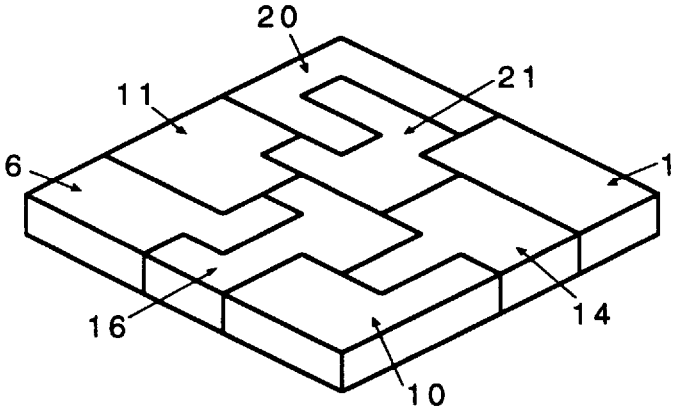
FIGS. 8–10 are perspective views of two- and three-dimensional assemblages of a second set of puzzle pieces, in a manner analogous to FIGS. 5–7.
Figure 9:
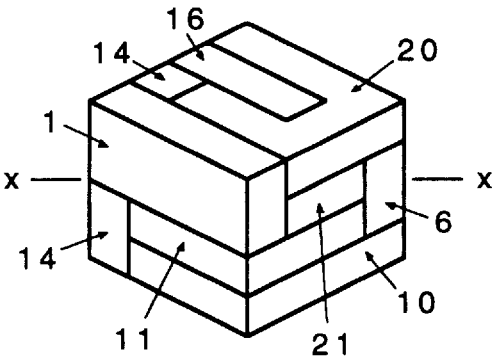
Figure 10:
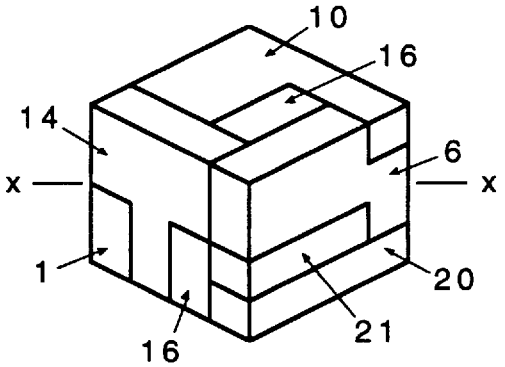

The second embodiment (FIGS. 8–10) consists of piece numbers 1, 6, 10, 11, 14, 16, 20 and 21 in FIG. 4. FIG. 8 shows one of 2 ways in which these pieces can be assembled to form a square, whereas FIGS. 9 and 10 show two different views of the pieces of FIG. 8 in the unique cube assemblage, related to each other by a 180 degree rotation about the axis x—x. FIGS. 9 and 10 show the only way these pieces can be assembled to form a cube. Shading of FIG. 8 is similar to FIG. 5, with no shaded surfaces being seen in FIGS. 9–10.

Figure 11:
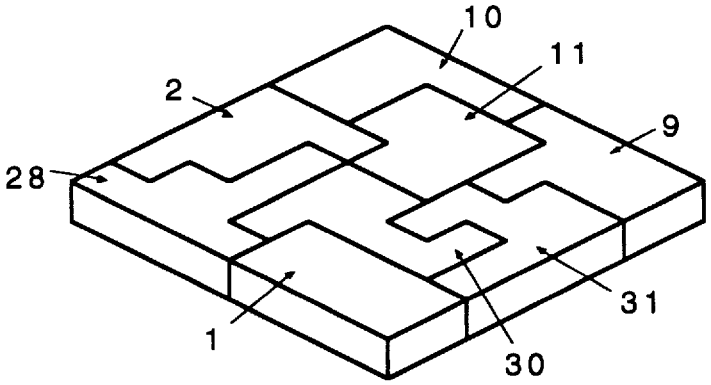
FIGS. 11–13, 14–16, 17–19, 20–22, 23–25, 26–28, 29–31, and 32–34 are perspective views of two- and three-dimensional assemblages of a third set through tenth set of puzzle pieces, in a manner analogous to FIGS. 5–7, wherein one Fig. of each set is rotated 180 degrees about an axis x—x.
Figure 12:
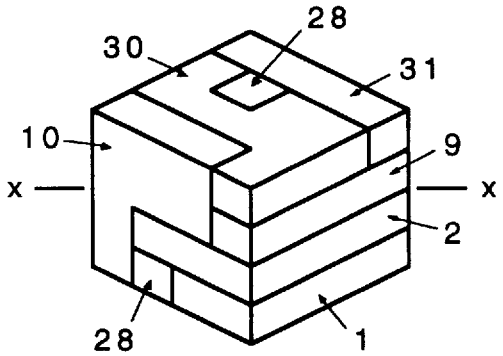
Figure 13:
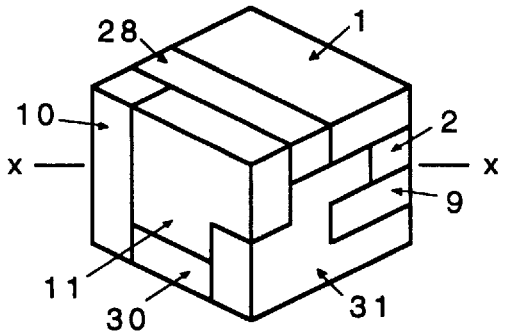

The third embodiment (FIGS. 1–13) consists of piece numbers 1, 2, 9, 10, 11, 28, 30 and 31 in FIG. 4. FIG. 11 shows the only way in which these pieces can be assembled to form a square, whereas FIG. 12 shows the only way in which these same pieces can be assembled to form a cube. In FIG. 13, the cube of FIG. 12 is rotated 180 degrees about axis x—x to show the back side thereof. As in the first embodiment, the top surfaces of the pieces of FIG. 14 may be visualized as being shaded, but none of the top surfaces appear in the cube assemblage of FIGS. 12–13.

Figure 14:
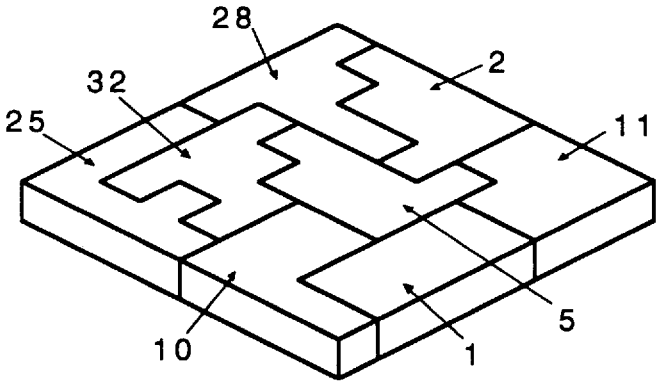
Figure 15:
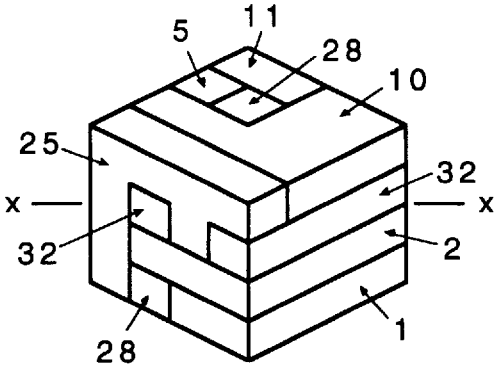
Figure 16:
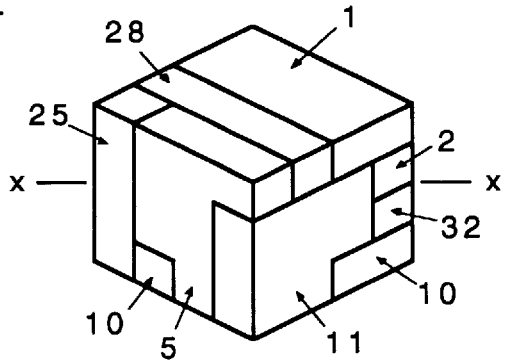

The fourth embodiment (FIGS. 14–16) consists of pieces 1, 2, 5, 10, 11, 25, 28 and 32 in FIG. 4. FIG. 14 shows one of two ways in which these pieces can be assembled to form a square, whereas FIG. 15 shows one of two ways in which these same pieces can be assembled to form a cube. FIG. 16 shows the cube of FIG. 15 rotated 180 degrees about axis x—x. The top surfaces of FIG. 14 cannot be seen in the cube assemblage of FIGS. 15–16, and thus are "hidden" surfaces.

Figure 17:
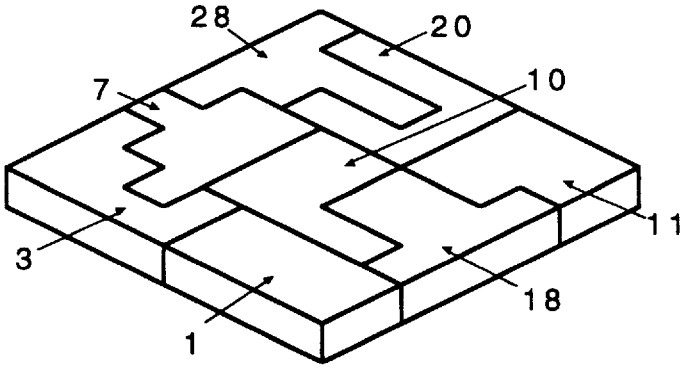
Figure 18:
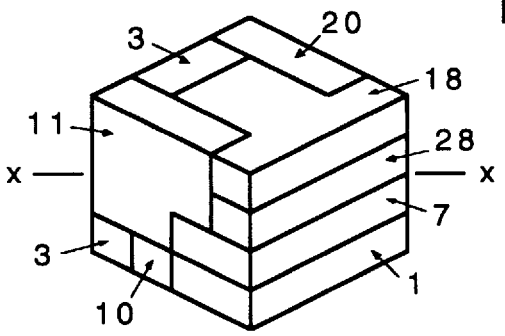
Figure 19:
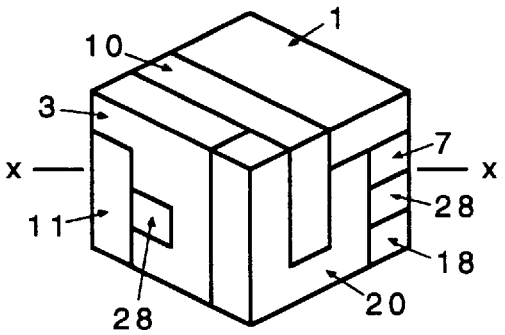

The fifth embodiment (FIGS. 17–19) consists of pieces 1, 3, 7, 10, 11, 18, 20 and 28 in FIG. 4. FIG. 17 shows one of two ways in which these pieces can be assembled to form a square, whereas FIG. 18 shows the only way in which these same pieces can be assembled to form a cube, with FIG. 19 showing a 180 degree rotation of FIG. 17 about axis x—x. As in the first embodiment, the top surfaces of FIG. 17 cannot be seen in the cube assemblage.

Figure 20:
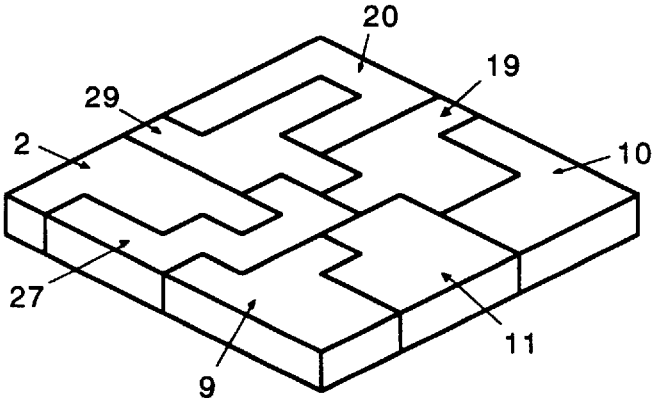
Figure 21:
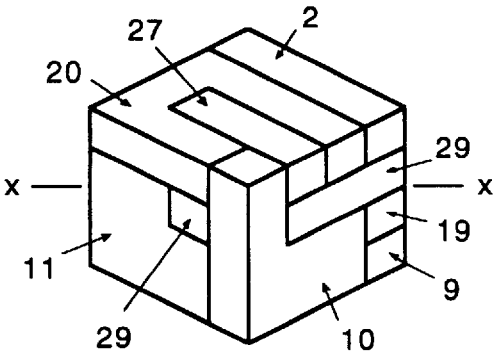
Figure 22:
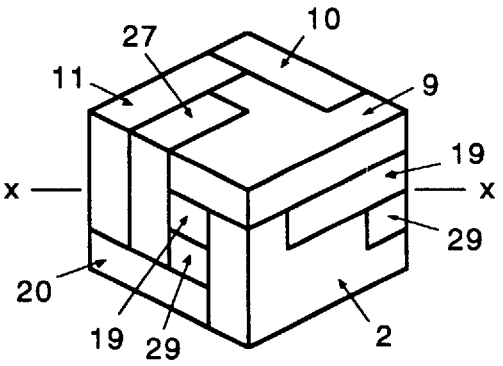

The sixth embodiment (FIGS. 20–22) consists of pieces 2, 9, 10, 11, 19, 20, 27 and 29 in FIG. 4. FIG. 20 shows one of two ways in which these pieces can be assembled to form a square, whereas FIG. 21 shows the only way in which these same pieces can be assembled to form a cube. FIG. 22 is a 180 degree rotation of FIG. 21 about axis x—x. The top surfaces of FIG. 20 are not visible in the cube assemblage of FIGS. 21–22.

Figure 23:
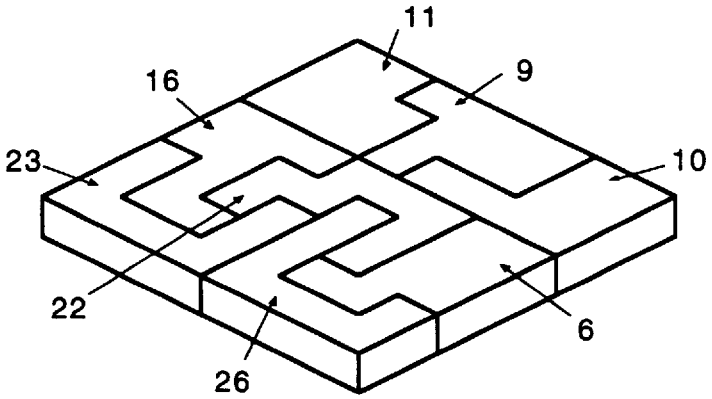
Figure 24:
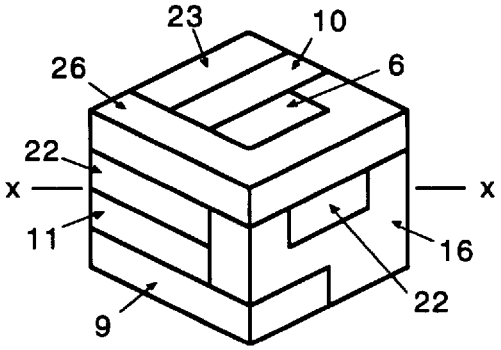
Figure 25:
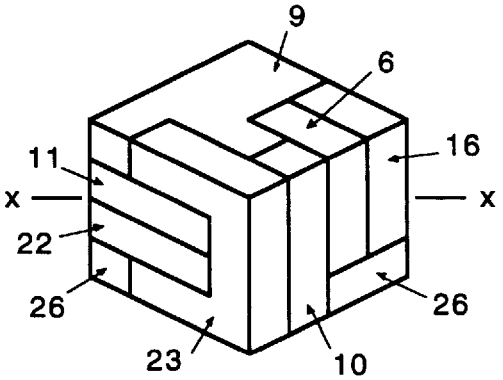

The seventh embodiment (FIGS. 23–25) consists of pieces 6, 9, 10, 11, 16, 22, 23 and 26 in FIG. 4. FIG. 23 shows one of eight ways in which these pieces can be assembled to form a square, while FIG. 24 shows one of two ways in which these same pieces can be assembled to form a cube. FIG. 25 shows a 180 degree rotation of FIG. 24 about axis x—x. This embodiment differs from the previously described embodiments in that two of the top surfaces (26 and 9) of FIG. 23 can be seen in FIGS. 24 and 25, respectively.

Figure 26:
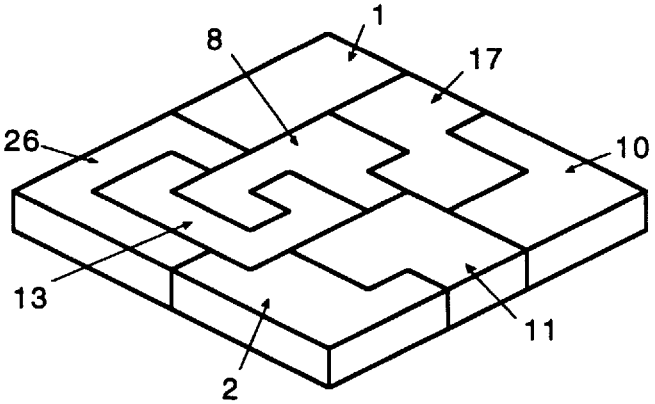
Figure 27:
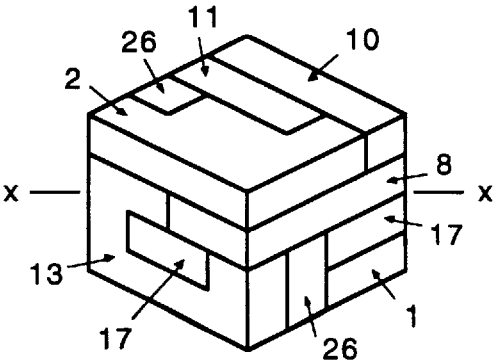
Figure 28:
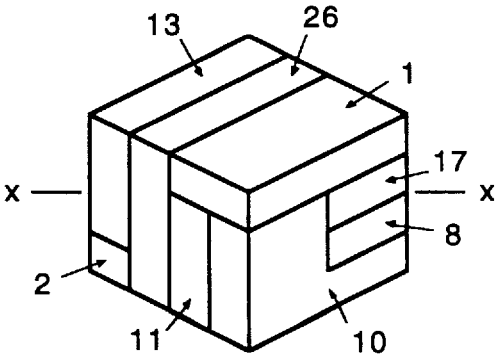

The eighth embodiment (FIGS. 26–28) consists of pieces 1, 2, 8, 10, 11, 13, 17 and 26 in FIG. 4. FIG. 26 shows the only way in which these pieces can be assembled to form a square, while FIG. 27 shows the only way in which these same pieces can be assembled to form a cube, with FIG. 28 showing a 180 degree rotation of FIG. 27 about axis x—x. As in the seventh embodiment, two of the top surfaces of pieces 2 and 10 of FIG. 26 can be seen in FIG. 27 or FIG. 28.

Figure 29:
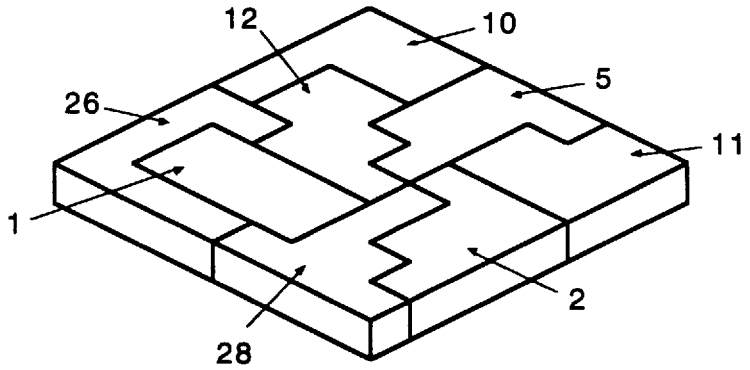
Figure 30:
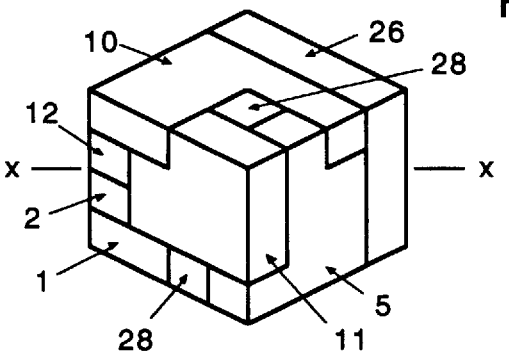
Figure 31:
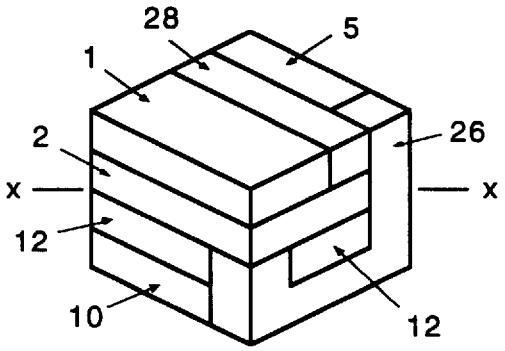

The ninth embodiment (FIGS. 29–31) consists of pieces 1, 2, 5, 10, 11, 12, 26, and 28 in FIG. 4. FIG. 29 shows the only way in which these pieces can be assembled to form a square, while FIG. 30 shows the only way in which these same pieces can be assembled to form a cube. FIG. 31 shows the cube of FIG. 30 rotated 180 degrees about axis x—x. As in the embodiments of FIGS. 23–25 and FIGS. 26–28, two of the surfaces of pieces (5 and 26) of FIG. 29 are seen in FIGS. 30 or 31.

Figure 32:
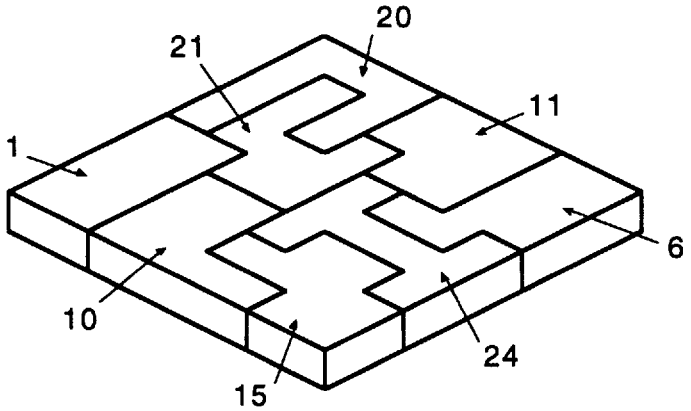
Figure 33:
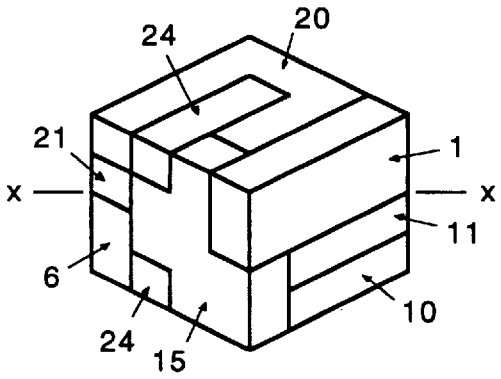
Figure 34:
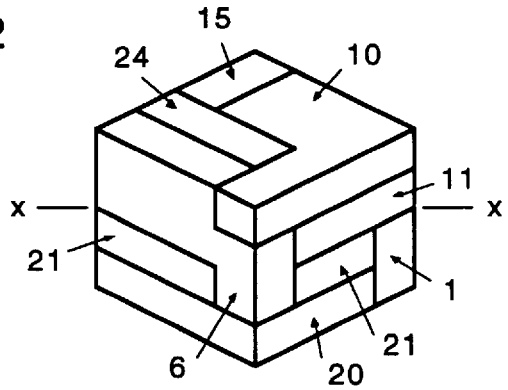

The tenth embodiment (FIGS. 32–34) consists of pieces 1, 6, 10, 11, 15, 20, 21 and 24 of FIG. 4. FIG. 32 shows the only way that these pieces can be assembled to form a square, whereas FIG. 33 shows the only way these same pieces can be assembled to form a cube, while FIG. 34 is a 180 degree rotation of FIG. 33 along axis x—x. As in the previous three embodiments, two of the top surfaces (pieces 20 and 6) of FIG. 32 can be seen in FIGS. 33 or 34.

The above ten embodiments illustrate that the same puzzle pieces can be assembled in two and three dimensions. This is accomplished, as set forth above, by utilizing a square two-dimensional assemblage of dimensions 8×8×1 units and a cubic three-dimensional assemblage of dimensions 4×4×4 units, with these assemblages using sixty-four unit cubes, each unit cube of dimensions 1×1×1. Also, as shown in the embodiments and set forth above, each puzzle piece is constructed of eight (8) unit cubes. Each of the embodiments utilizes eight (8) puzzle pieces or sixty-four unit cubes, with the eight puzzle pieces not including more than one mated pair, a mated pair consisting of two pieces that can be placed together to completely fill out a volume of dimensions 4×4×1. Such is exemplified by puzzle pieces 3 and 7 in FIG. 5, for example.

Of the ten (10) illustrated embodiments, six (6) have a "hidden surface" feature in which all of the surfaces of pieces that comprise the top surface of the two-dimensional assemblage become interior surfaces of the cube assemblage. Thus, the square two-dimensional puzzle can provide a depiction or illustration of a desired pattern, picture, or color arrangement, and such depiction will not show on any of the outside surfaces of the three-dimensional assemblage of these same pieces. Likewise, the outside surfaces of a cube assemblage, such as the embodiment of FIGS. 12 and 13, may define a satellite image of the earth, for example, but such will not be seen on the top surface of the square two-dimensional image of FIG. 11 which utilizes the same eight puzzle pieces. Such colors, patterns, or pictures can greatly reduce the puzzle complexity, if desired, by providing additional assembly clues, and can serve to make the puzzles more pleasing visually.

Also, as pointed out above, the linear dimension L=4 of the 4×4×4 cube assemblage is unique, being the smallest nontrivial linear dimension for which a set of puzzle pieces that fill out the cube assemblage can also completely fill out a square assemblage of unit thickness, and thus the sixty-four unit cubes needed to fill out the 4×4×4 cube assemblage also completely fill out an 8×8×1 square assemblage. Thus, by the use of the linear dimension L=4, rather than another linear dimension, as set forth above, two- and three-dimensional puzzles can be assembled which challenge the intellect, and even allow for separate pictures to appear on the top surfaces of the square and outside surfaces of the cube.

While ten embodiments and thirty-two puzzle pieces have been illustrated for the linear dimension L=4 of the cube assemblage, the invention is not limited to these specific embodiments or number of puzzle pieces. Additional puzzle pieces and embodiments can be developed utilizing the criteria set forth above. The scope of this invention includes other embodiments developed by using, for example, a linear dimension 9 or other squares of integers, fitting together the described piece, or equivalents, in different ways.

While particular embodiments of the invention have been illustrated and described to exemplify and set forth the principles of the two/three dimension puzzle pieces, such are not intended to be limiting, and numerous other puzzle piece assemblages can be made for linear dimension L=4 of the cube assemblage, each using an eight puzzle piece arrangement, as set forth in Table I. Modifications and changes may become apparent to those skilled in the art, and it is intended that the invention be limited only by the scope of the appended claims.

What is claimed is:

1. In a block puzzle game, the improvement comprising:

a plurality of flat puzzle pieces of uniform thickness, each piece defining a same number of unit cubes, which:

(a) can be assembled side-by-side to completely fill the interior area of a well-defined two-dimensional shape of a square or rectangle, the resulting flat two-dimensional assemblage having uniform thickness equal to the thickness of the individual pieces, and (b) can also be assembled both vertically and horizontally to completely fill the interior volume of a well-defined three-dimensional shape of a cube or rectangular parallelopiped, wherein each of said plurality of puzzle pieces is used once and only once in both the two-dimensional and three-dimensional assemblages.

2. The improvement of claim 1, wherein each of said plurality of puzzle pieces is composed of a plurality of unit cubes, wherein each of said plurality of unit cubes has dimensions of one unit wide by one unit long by one unit high, wherein said dimension of one unit can be any length measurement unit, wherein said plurality of unit cubes are constructed to be secured firmly together with faces thereof being flush against each other, to form a connected two-dimensional piece of unit thickness.

3. The improvement of claim 2, wherein said three-dimensional assemblage is a cube of dimensions of L units wide by L units long by L units high, and wherein said two-dimensional assemblage is a square of dimensions D units wide by D units long by one unit thick, where $L=N^2$ is the square of an integer N which is greater than one, and where $D=N^3$ is the cube of the same integer.

4. The improvement of claim 3, wherein each of said plurality of puzzle pieces is composed of D unit cubes, and wherein said plurality of puzzle pieces consists of D distinct puzzle pieces, each of said D puzzle pieces having a different shape from every other.

5. The improvement of claim 4, wherein N=2, and wherein said three-dimensional assemblage is a cube of dimensions of four units wide by four units long by four units high, and wherein said two-dimensional assemblage is a square of dimensions eight units wide by eight units long by one unit thick, and wherein said plurality of puzzle pieces consists of eight distinct puzzle pieces, each piece being composed of eight unit cubes.

6. The improvement of claim 5, wherein said eight distinct puzzle pieces may not include more than one mated pair, a mated pair consisting of two puzzle pieces that can be placed together to completely fill out a volume of dimensions four units wide by four units long by one unit thick.

7. The improvement of claim 1, wherein said plurality of puzzle pieces are constructed such that the top surface of each puzzle piece in said two-dimensional assemblage is not exposed in any of the exterior surfaces of said three-dimensional assemblage.

8. The improvement of claim 7, wherein said top surface of the two-dimensional assemblage contains a depiction different than the depictions on the exterior surfaces of the three-dimensional assemblage.

9. The improvement of claim 6, wherein at least 32 puzzle pieces can be used to form at least ten different two/three dimensional assemblages, each two/three dimensional assemblage being composed of eight pieces.

10. The improvement of claim 9, wherein at least six of the at least ten different two/three dimensional assemblages contain puzzle pieces that have top surfaces exposed in the two-dimensional assemblage which are not exposed in the three-dimensional assemblage.

11. A two/three dimensional puzzle, comprising:

a plurality of puzzle pieces, each piece defining a same number of unit cubes, said puzzle pieces being constructed to be assembled into square two-dimensional and cubic three-dimensional assemblages, each of said two-dimensional and three-dimensional assemblages consisting of puzzle pieces which completely fill an interior area of a two-dimensional shape and three-dimensional shape.

12. The puzzle of claim 11, wherein said plurality of puzzle pieces consists of at least thirty-two puzzle pieces, each of said puzzle pieces containing eight units secured together to form a connected two-dimensional shape.

13. The puzzle of claim 12, wherein said thirty-two puzzle pieces can be assembled to form at least ten different two/three dimensional assemblages, six of said ten two/three dimensional assemblages containing top surfaces of a two-dimensional assemblage which are hidden in a three-dimensional assemblage.

14. The puzzle of claim 11, wherein each of said two-dimensional and three-dimensional assemblages consist of eight puzzle pieces.

15. The improvement of claim 11, wherein each of said puzzle pieces contain eight units, and wherein said plurality of puzzle pieces are composed of sixty-four units and are constructed to fill out a 4×4×4 cube assemblage and fill out an 8×8×1 square assemblage.

16. The improvement of claim 15, wherein said plurality of puzzle pieces are each composed of eight pieces, each piece of said eight pieces being a different than another of each piece of said eight pieces.

17. The improvement of claim 15, wherein each unit of said eight units has a dimension of one unit, and wherein said dimension of one unit may be constructed of different lengths.

18. The improvement of claim 11, wherein a set of said plurality of puzzle pieces may not include more than one mated pair, a mated pair consisting of two puzzle pieces that can be placed together to completely fill out a volume of dimension 4×4×1 unit cubes.

19. The improvement of claim 18, wherein said puzzle pieces of a set are constructed such that a top surface of each puzzle piece in a two-dimensional assemblage is not exposed in a three-dimensional assemblage.

20. A puzzle comprising:

eight component pieces, each component piece being composed of eight unit cubes, said eight component pieces each having a unit of any length measurement, and being constructed to be assembled in either a two-dimensional assemblage or in a three-dimensional assemblage, and said eight component pieces being constructed to fit together to completely fill out a volume of a square eight units wide by eight units long by one unit high and to also completely fill out a volume of a cube four units wide by four units long by four units high.

* * * * *